United States Patent [19]

Gardiner

[11] Patent Number: 4,625,741

[45] Date of Patent: Dec. 2, 1986

[54] NAIL POLISHER

[76] Inventor: David Gardiner, 15140 Kittridge Ave., Van Nuys, Calif. 91405

[21] Appl. No.: 643,557

[22] Filed: Aug. 23, 1984

[51] Int. Cl.[4] ..... A45D 40/00

[52] U.S. Cl. ..... 132/79 B; 401/132; 401/135; 401/129

[58] Field of Search ..... 401/132, 133, 134, 135, 401/137, 138, 129; 132/DIG. 3, 79 B, 74.5; 15/167 B, 191 A

[56] References Cited

U.S. PATENT DOCUMENTS

| | | | |
|---|---|---|---|
| 1,705,256 | 3/1929 | Krusi | 132/79 B |
| 2,104,651 | 1/1938 | Hoffman, Jr. | 132/74.5 |
| 2,813,289 | 11/1957 | Even | 401/129 |
| 3,152,352 | 10/1964 | Kosik, Jr. | 401/132 |
| 3,341,884 | 9/1967 | Pryor | 401/129 |
| 3,393,962 | 7/1968 | Andrews | 401/132 |
| 3,556,667 | 1/1971 | Kaufman | 401/132 X |
| 3,738,762 | 6/1973 | Moore et al. | 401/186 |
| 3,757,782 | 9/1973 | Aiken | 401/132 |
| 3,759,259 | 9/1973 | Truhan | 401/132 |
| 3,792,699 | 2/1974 | Tobin | 401/133 |
| 3,891,331 | 6/1975 | Avery | 401/132 |
| 4,049,354 | 9/1977 | O'Rourke | 401/134 |
| 4,140,409 | 2/1979 | DeVries | 401/132 |
| 4,218,155 | 8/1980 | Weidner | 401/132 |
| 4,222,677 | 9/1980 | Cervantes | 401/129 |
| 4,432,749 | 2/1984 | Snyder et al. | 401/132 |
| 4,447,169 | 5/1984 | Vartoughian | 401/129 |
| 4,572,689 | 2/1986 | Chernack | 401/132 |

FOREIGN PATENT DOCUMENTS

| | | | |
|---|---|---|---|
| 2440413 | 4/1975 | Fed. Rep. of Germany | 401/132 |

*Primary Examiner*—Robert P. Swiatek
*Assistant Examiner*—Cary E. Stone
*Attorney, Agent, or Firm*—Rapkin, Gitlin & Moser

[57] ABSTRACT

The present invention of a self-contained nail polishing device comprises an elongated and flexible tubular shaped housing, which includes an interior chamber for containing liquid nail polish, exterior sidewalls, a valve assembly at one end to adjust airflow to the chamber, and a brush mounted on the opposite end of the housing to receive polish from the chamber, when pressure is exerted on the sidewalls, for applying same to finger and toe nails.

6 Claims, 5 Drawing Figures

NAIL POLISHER

BACKGROUND OF THE INVENTION

1. Field of the Invention

The present invention relates generally to the field of cosmetics and more particularly to polishers for finger and toe nails.

2. Description of the Prior Art

Finger nail polish and polishing implements are well known within the art. Presently, nail polish used for manicures and pedicures is sold in predominantly glass containers with the applicator formed as an appendage to the bottle cap. In all cases known to the applicant, the user must grasp the applicator in a somewhat precarious position between the thumb, index and second fingers. Held in this manner, the applicator can easily slip from the user's grasp and fall to the floor or other surface causing damage. The risks that an open bottle of polish will tip or fall over and break and cause an even greater mess are often realized. Other disadvantages of the prior art devices include the presence of dry, crusty and usually unsightly residue of polish found around the bottle neck.

The present invention seeks to improve upon the prior art by providing a self-contained nail polisher that includes a housing shaped substantially like a writing implement that holds within it a quantity of nail polish which, when pressure is exerted on the exterior walls of the housing, ruptures a seal and flows through to a brush attached to the end of the housing. The present invention seeks further to alleviate problems relating to, among others, glass breakage and polish spillage, while providing the user with a device that is more controllable than those that already exist in the prior art.

The advantages and distinctions of the present invention over the prior art will become clearly evident in the following disclosure.

SUMMARY OF THE INVENTION

The present invention of a nail polishing device comprises an elongated and flexible tubular shaped housing, which includes an interior chamber for containing a liquid substance, such as polish, exterior sidewalls, a valve assembly at one end to automatically adjust airflow to the chamber, and a brush mounted on the opposite end of the housing to receive polish from the chamber and for applying same to finger and toe nails.

The primary object of the present invention is to provide a self-contained nail polisher that is easily held and controlled by the user.

Another object of the invention is to provide a self-contained nail polisher that alleviates the risk of polish spillage and the associated damages to property.

Still another object of the invention is to provide a self-contained nail polisher that is resilient in structure and relatively simple and inexpensive to manufacture.

Other objects and advantages will become apparent in the following specifications when considered in light of the attached drawings wherein a preferred embodiment of the invention is illustrated.

DESCRIPTION OF THE PREFERRED EMBODIMENT

Figure 1:
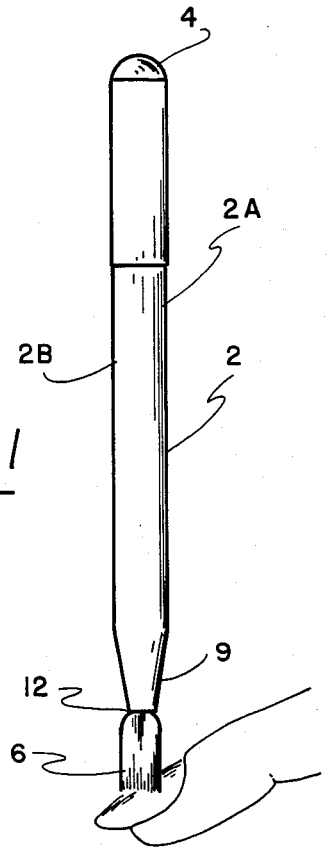
FIG. 1 is a perspective view of a self-contained nail polisher constructed in accordance with the present invention.
Figure 2:
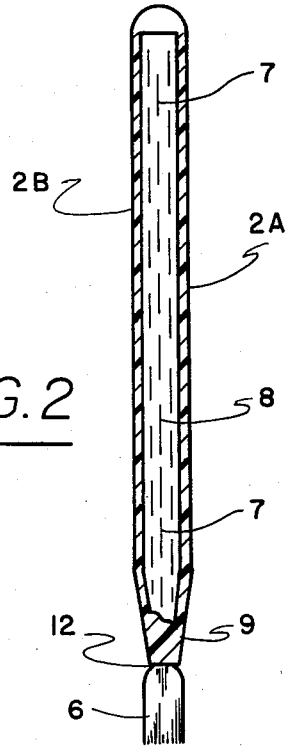
FIG. 2 is a sectional view of the present invention.
Figure 3:
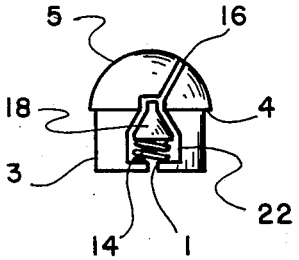
FIG. 3 is a sectional view of the valve assembly portion of the present invention.
Figure 4:
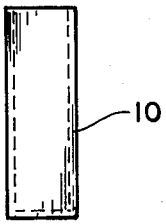
FIG. 4 is a perspective view of the cap that covers the brush of the present invention.
Figure 5:
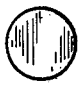
FIG. 5 is a top view of the cap that covers the brush of the present invention.

Referring now to the drawings in detail, the self-contained nail polisher in one form is depicted in FIG. 1. A sectional view of the nail polisher, including liquid polish filling the interior chamber, is depicted in FIG. 2. FIG. 3 depicts a sectional view of the valve assembly and FIG. 4 depicts a cap for covering the brush of the present invention.

Reference numeral 2 indicates the barrel or primary housing for the device of the present invention. Housing 2 is preferable transparent and may be made of any suitable resilient material, such as, for example, plastic. Housing 2 includes sidewalls 2*a* and 2*b* and interior chamber 8 for containing a liquid substance 7, such as nail polish. Chamber 8 is attached on opposite ends to valve assembly 4 and applicator 6, respectively. Valve assembly 4 automatically adjusts the airflow to chamber 8 and includes a domed cap portion 5 mounted on a base 3. Cap 5, which includes aperture or airway 16 therethrough, and base 3, which includes aperture 1 through the bottom thereof, define an interior cavity 22 which contains a valve stem 18 positioned adjacent to coiled spring 14.

Applicator 6 is attached to tapered end 9 of housing 2. Although a plurality of bristles comprising a brush is preferred, applicator 6 may also take the form of any absorptive material, such as sponge or cotton. Between applicator 6 and tapered end 9 is affixed a breakable seal 12 used to temporarily restrain the flow of polish to applicator 6. Cap 10, typically formed from any suitable substance, such as, for example, plastic, is placed over applicator 6 to prevent "dry out" when the invention is not in use and the applicator is exposed to the air too long. To operate the present invention, the user exerts pressure anywhere along the sidewalls 2*a* and 2*b* of housing 2 to force the polish toward seal 12. When sufficient pressure is exerted, the polish is forced against the bottom of valve stem 18, which then contacts the opening at the bottom of dome 5 to close airway 16. At the same time, the polish penetrates seal 12 and flows out of chamber 8 onto or throughout the material forming applicator 6. When pressure upon the sidewalls is released, valve stem 18 retreats from the opening of airway 16 to allow a continuous free flow of the polish to the brush, the preferred embodiment of applicator 6. When the brush is sufficiently intermixed with the polish, the user then takes hold of the invention as one would with a writing implement, such as a pen or pencil, and begins to apply the polish to the surface of the nail.

Having thus described the preferred embodiment of the invention it should be understood that numerous structural modifications and adaptations may be resorted to without departing from the spirit and scope of the invention.

I claim:

1. An elongated polishing device substantially in the shape of a writing instrument comprising:

a first flexible housing, said first housing including a chamber containing a liquid substance, generally uniformly equidistant side walls, a first end portion and a second end portion, said second end portion comprising a valve assembly, including a second housing means, said second housing means including a top portion and a base portion, a coiled spring positioned within said second housing, a valve stem positioned adjacent to said coiled spring, a first hole through said second housing formed through said top portion and in spaced opposed relation with said valve stem and a second hole positioned vertically through said base portion of said second housing means;

a means fixedly secured to said first end portion for receiving and applying said liquid, said means for receiving and applying said liquid having a width that is substantially equal to that of the widest portion of said first flexible housing; and, a breakable seal joining said first end portion and said means fixedly secured to said first end portion for receiving and applying said liquid when pressure is exerted on said side walls.

2. The device of claim 1 wherein said first housing is tubular shaped such that it may be held and controlled like a writing instrument.

3. The device of claim 2 wherein said means to receive and apply said liquid substance comprises a plurality of bristles.

4. The device of claim 3 wherein said liquid substance comprises finger nail polish.

5. The device of claim 4 wherein said means to receive and apply said liquid substance is enclosed within a covering means.

6. The device of claim 5 wherein said covering means comprises a plastic cap.

* * * * *